US011933176B2

(12) United States Patent
Wu et al.

(10) Patent No.: US 11,933,176 B2
(45) Date of Patent: Mar. 19, 2024

(54) FABRICATED OCEAN TUNNEL STRUCTURE WITH ESCAPE DEVICE AND APPLICATION METHOD THEREOF

(71) Applicant: Shandong University, Jinan (CN)

(72) Inventors: Ke Wu, Jinan (CN); Yajun Liu, Jinan (CN); Zhenhua Liu, Jinan (CN); Zhongyu Dou, Jinan (CN); Wenbin Xu, Jinan (CN); Dapeng Liu, Jinan (CN)

(73) Assignee: Shandong University, Jinan (CN)

( * ) Notice: Subject to any disclaimer, the term of this patent is extended or adjusted under 35 U.S.C. 154(b) by 0 days.

(21) Appl. No.: 18/453,868

(22) Filed: Aug. 22, 2023

(65) Prior Publication Data

US 2023/0392499 A1 Dec. 7, 2023

Related U.S. Application Data

(63) Continuation of application No. PCT/CN2021/096631, filed on May 28, 2021.

(30) Foreign Application Priority Data

May 26, 2021 (CN) ..... 202110575527.7

(51) Int. Cl.

| | |
|---|---|
| ***E21D 9/14*** | (2006.01) |
| ***B63G 8/40*** | (2006.01) |
| ***B63G 8/41*** | (2006.01) |
| ***E21F 11/00*** | (2006.01) |

(52) U.S. Cl.

CPC ..... *E21D 9/14* (2013.01); *B63G 8/40* (2013.01); *E21F 11/00* (2013.01); *B63G 8/41* (2013.01)

(58) Field of Classification Search

CPC ..... E21D 9/14; E21F 11/00; B63G 8/41

See application file for complete search history.

(56) References Cited

FOREIGN PATENT DOCUMENTS

| | | | | |
|---|---|---|---|---|
| CA | 2209039 | A1 | | 1/1999 |
| CN | 102720210 | A | | 10/2012 |
| CN | 107642377 | A | | 1/2018 |
| CN | 111088994 | A | * | 5/2020 |
| CN | 111088994 | A | | 5/2020 |
| CN | 111254978 | A | | 6/2020 |

(Continued)

OTHER PUBLICATIONS

Internation Search Report of PCT/CN2021/096631, dated Mar. 2, 2022.

*Primary Examiner* — Janine M Kreck

(57) ABSTRACT

The present invention belongs to the technical field of ocean traffic engineering, and relates to a fabricated ocean tunnel structure with an escape device and an application method thereof. The present invention includes a fabricated ocean tunnel structure and an escape device. the partition plate separates a middle bin in the tunnel, and the escape device is connected into the middle bin; and the escape device includes a rescue capsule, transverse ladders are evenly arranged in the rescue capsule, and a balancing weight block and a rescue equipment area are arranged at the bottom of the rescue capsule. The ocean tunnel structure can be provided with a rescue device during installation, and the safety of personnel escape can be guaranteed; therefore, the safety of the ocean tunnel structure is improved, cost is relatively low, secondary damage to the ocean tunnel structure is not needed.

6 Claims, 3 Drawing Sheets

(56) References Cited

FOREIGN PATENT DOCUMENTS

| | | | |
|---|---|---|---|
| CN | 111877401 | A | 11/2020 |
| EP | 3366882 | A1 | 8/2018 |
| JP | 2007537375 | A | 12/2007 |
| KR | 20200033575 | A | 3/2020 |
| KR | 20200095184 | A | 8/2020 |
| WO | 2008072978 | A2 | 6/2008 |

* cited by examiner

FABRICATED OCEAN TUNNEL STRUCTURE WITH ESCAPE DEVICE AND APPLICATION METHOD THEREOF

CROSS-REFERENCE TO RELATED APPLICATIONS

This application is a continuation of International Patent Application No. PCT/CN2021/096631 with a filing date of May 28, 2021, designating the United States, now pending, and further claims priority to Chinese Patent Application No. 202110575527.7 with a filing date of Mar. 26, 2021. The content of the aforementioned applications, including any intervening amendments thereto, are incorporated herein by reference.

TECHNICAL FIELD

The present invention belongs to the technical field of ocean traffic engineering, and particularly relates to a fabricated ocean tunnel structure with an escape device and an application method thereof.

BACKGROUND

At present, the inland traffic network is gradually improved, and traffic construction gradually focuses on the ocean, including cross-sea bridges and ocean tunnel structures. Herein, the ocean tunnel structure is located in an ocean environment, and while facing an external high-pressure oxygen-free environment, the only passage is a tunnel road. In the case of local fire, equipment configured in the ocean tunnel structure can effectively solve the problem and ensure the safety of personnel. However, in the case of sudden serious accidents such as explosion, large-scale fire and tunnel rupture, the personnel need to escape in a very short time and a very short distance before being rescued. In the existing ocean tunnel structure, the probability of personnel escape is slim.

In order to solve the above problem, there have been some researches on an emergency escape system of the ocean tunnel structure in the prior art. For example, in the Chinese invention patent entitled "Emergency Escape System for Fire of Ocean Tunnel Structure", it is attempted to build a transit building to ensure the safety of the escape personnel, which can be implemented in short-distance (500-1,000 m long) tunnels, but if the tunnel is hundreds of kilometers long, it is impossible to build an ocean building every one kilometer and meanwhile impossible to break the ocean tunnel structure and rebuild same in terms of engineering feasibility.

The structural safety of the ocean tunnel structure is important, but the problem of escape from a disaster after an accident must also be considered. Therefore, in view of the above shortcomings of the ocean tunnel structure, the present invention provides a fabricated ocean tunnel structure with an escape device, and further discusses an application method of the fabricated ocean tunnel structure in detail.

SUMMARY

In order to solve the shortcomings in the prior art, the present invention specifically discloses a fabricated ocean tunnel structure with an escape device and an application method thereof, which can effectively solve the problem of escape of personnel in an ocean tunnel structure in various ways without affecting the integrity and functionality of the ocean tunnel structure.

To achieve the above objective, the present invention uses the following technical solutions:

a fabricated ocean tunnel structure with an escape device, including a fabricated ocean tunnel structure and an escape device. The escape device is located at the middle portion of the ocean tunnel structure, and the middle portion is fixed to a first rotary lock switch by means of an N-shaped rotary lock switch.

The fabricated ocean tunnel structure includes a tunnel outer wall, a tunnel middle wall, a tunnel sidewall, a motor equipment bin, a top plate, a partition plate, a traffic area, a middle bin, a primary water pipe, a secondary water pipe, a partition door, a first rotary lock switch, a pavement area, a seal plate and a seal plate knob. The tunnel sidewall is located at both ends of the tunnel and located in the middle of the tunnel, the tunnel middle wall is located at the middle portion of the tunnel and located in the middle of the tunnel, the top plate is located at the upper portion of the tunnel to separate the traffic area and the motor equipment bin, the partition plate is located in the middle of the tunnel, the partition plate separates the middle bin in the tunnel, meanwhile the partition plate is attached to the tunnel sidewall and the tunnel middle wall, the primary water pipe is buried in the middle portion of the pavement area, starting from the middle bin at the edge of the tunnel and ending, in the tunnel direction, at the middle bin at the other end of the tunnel, the secondary water pipe is located between the primary water pipe and the middle bin, the partition doors are evenly arranged in the partition plate at certain intervals, the first rotary lock switch is located on the partition door, the partition door can be opened and closed by rotating the first rotary lock switch clockwise and counterclockwise, the pavement area is distributed at the bottom of the tunnel, and the seal plate is located at the top of the middle bin and can be opened and closed in the tunnel direction along with the seal plate knob at the edge of the seal plate.

The escape device includes a rescue capsule outer wall, a rescue capsule inner wall, a support, an N-shaped rotary lock switch, a rescue capsule outer wall hatch, a rescue capsule inner wall hatch, a bidirectional rotary lock switch, a rescue capsule top hatch, an observing window hole, a rescue capsule knob, a Global Positioning System (GPS) positioning device, a transverse ladder, a rescue area, a rescue equipment area and a balancing weight block. The rescue capsule outer wall is separated from the rescue capsule inner wall by a certain gap and connected thereto by means of the arranged support distributed at a specified position, the rescue capsule outer wall hatch and the rescue capsule inner wall hatch are located on both sides of the middle portion of the rescue capsule outer wall and the rescue capsule inner wall and connected by means of the N-shaped rotary lock switch, the N-shaped rotary lock switch is located at the middle portion of the outer rescue capsule door and the outer rescue capsule door, the rescue capsule top hatch is located at the top of the rescue capsule, the bidirectional rotary lock switch is located at the middle portion of the rescue capsule top hatch, and can rotate inside and outside the rescue capsule to open or close the rescue capsule top hatch, the observing window hole is located on the periphery of the rescue capsule top hatch, the rescue capsule knob is located at the edge of the rescue capsule top hatch so that the rescue capsule top hatch can rotate, the GPS positioning device is located on the upper side of the outer portion of the rescue capsule outer wall, the rescue area is located in an inner area of the rescue capsule inner wall, the transverse ladders are horizontally and evenly distributed in the rescue capsule inner wall, the balancing weight block is located at the bottommost portion of the rescue area, the rescue equipment area is located at the upper portion of the balancing weight block, and the balancing weight block and the rescue equipment area are detachable.

When the fabricated ocean tunnel structure is installed, the seal plate is rotated and opened in the tunnel direction through the seal plate knob, then the rescue capsule is hoisted into the middle bin, the N-shaped rotary lock switch is vertically and downwards connected and fixed to the first rotary lock switch by means of a buckle, and the lower portion of the N-shaped rotary lock switch contacts the pavement area. The seal plate is closed and then the installation of the rescue device is completed, then splicing installation for offshore operations is performed according to a common fabricated construction process.

In normal operation, the tunnel outer wall is in contact with the ocean environment and bears dynamic loads such as structural weight, water pressure and waves. The tunnel middle wall and the tunnel sidewall support the middle portion of the tunnel and bear part of the upper load which is transferred to the tunnel outer wall at the bottom of the tunnel. The motor equipment bin at the upper portion of the tunnel stores a device such as a wire and optical cable ventilation duct, and the top plate bears the vertical load of the device in the motor equipment bin. A vehicle runs on the pavement area in the traffic area, and there is no water flow between the primary water pipe and the secondary water pipe during normal operation. Usually, the seal plate is in a sealed state, only the partition plate and the partition door can be seen in the traffic area, and the rescue capsule is located in the partition plate.

In case of emergency escape, there are four scenarios as follows:

1. the first scenario is that a detection device detects that a disaster occurs and personnel need to escape, and ground personnel check, after receiving the news, the disaster situation, determine the personnel evacuation situation and set an escape time; the partition door, the rescue capsule outer wall hatch and the rescue capsule inner wall hatch drive the N-shaped rotary lock switch to open automatically with the rotation of the first rotary lock switch, the hatches are automatically closed when the personnel are in place, and meanwhile the seal plate is opened into the tunnel by means of the seal plate knob, so that seawater pours into the middle bin;
2. the second scenario is that the detection device detects that a disaster occurs and personnel need to escape, and the ground personnel fail, after receiving the news, to make a judgment in time; according to a preset escape time of the system, the partition door, the rescue capsule outer wall hatch and the rescue capsule inner wall hatch drive the N-shaped rotary lock switch to open automatically with the rotation of the first rotary lock switch, the hatches are closed manually when the personnel are in place, the seal plate is opened in linkage, and the seawater pours into the middle bin;
3. the third scenario is that the detection device detects that a disaster occurs and personnel need to escape, and the ground personnel fail, after receiving the news, to make a judgment in time; and according to a preset escape time of the system, the partition door, the rescue capsule outer wall hatch and the rescue capsule inner wall hatch drive the N-shaped rotary lock switch to open automatically with the rotation of the first rotary lock switch, the hatches are automatically closed when the personnel are in place, and meanwhile the seal plate is opened into the tunnel by means of the seal plate knob, so that the seawater pours into the middle bin; and
4. the fourth scenario is that the detection device fails to detect a disaster, the personnel rotate the first rotary lock switch on the partition door by themselves, the partition door, the rescue capsule outer wall hatch and the rescue capsule inner wall hatch drive, with the rotation of the first rotary lock switch, the N-shaped rotary lock switch to open, the N-shaped rotary lock switch is, after the personnel are in place, manually rotated to close the hatches, and meanwhile the seal plate is opened in linkage, so that the seawater pours into the middle bin.

There are two ways to cause the middle bin full of seawater: the first way is that the seawater downward pours from a position where the seal plate at the upper portion of the middle bin is opened, and the other way is that the seawater pours into the middle bin by means of the primary water pipe and the secondary water pipe after pouring from another middle bin, so as to ensure that the middle bin is filled with the seawater.

Then, after the buoyancy of the rescue capsule is greater than the gravity thereof, the rescue capsule floats upward, and the N-shaped rotary lock switch is vertically separated from a first rotary lock switch, thus automatically canceling the fixation of the rescue capsule; due to the function of the balancing weight block, the floating posture of the rescue capsule remains stable, and the GPS positioning device is turned on after encountering water, so that external search and rescue personnel can locate the rescue capsule in real time; and the rescue equipment area is equipped with oxidant sodium peroxide and the like, and further with food and water, which can ensure the life needs of an evacuee within a certain period of time; and after the rescue capsule floats to the surface of the sea, the personnel, after determining an arrival at the surface of the sea through the observing window hole, climb the transverse ladder and rotate the bidirectional rotary lock switch to open the rescue capsule top hatch by means of the rescue capsule knob to breathe air and wait for rescue, and meanwhile a rescuer can also rotate the bidirectional rotary lock switch from the outside to open the rescue capsule top hatch for rescue.

Beneficial Effects

The present invention discloses a fabricated ocean tunnel structure with an escape device. The fabricated ocean tunnel structure with an escape device can be provided with a complete rescue device during installation, and the safety of personnel escape can also be guaranteed in multiple ways; therefore, the safety of the ocean tunnel structure is improved. As a whole, the tunnel rescue device is convenient to install, simple in structure, relatively low in cost, and safe and reliable without the need of secondary damage to the ocean tunnel structure.

In the figure: 1, seal plate; 2, motor equipment bin; 3, partition plate; 4, tunnel outer wall; 5, traffic area; 6, N-shaped rotary lock switch; 7, secondary water pipe; 8, seal plate knob; 9, top plate; 10, rescue capsule outer wall; 11, partition door; 12, first rotary lock switch; 13, primary water pipe; 14, pavement area; 15, middle bin; 16, tunnel middle wall; 17, tunnel sidewall; 18, bidirectional rotary lock switch; 19, rescue capsule top hatch; 20, observing window hole; 21, rescue capsule knob; 22, GPS positioning device; 23, rescue capsule inner wall; 24, transverse ladder; 25, rescue area; 26, rescue capsule outer wall hatch; 27, rescue capsule inner wall hatch; 28, rescue equipment area; 29, balancing weight block; and 30, support.

DETAILED DESCRIPTION OF ILLUSTRATIVE EMBODIMENTS

Hereinafter, the present invention will be described in detail. Before the description, it should be understood that the terms used in the present specification and the appended claims should not be interpreted as limited to the general meaning and dictionary meaning, but should be interpreted according to the meanings and concepts corresponding to the technical aspects of the present invention on the basis of the principle of allowing inventors to properly define terms for the best interpretation. Therefore, the description presented here is only a preferred example for illustrative purposes, and it is not intended to limit the scope of the present invention, so it should be understood that other equivalent ways or improvements can be obtained therefrom without departing from the spirit and scope of the present invention.

The following embodiments are only listed as examples of the implementations of the present invention, and do not constitute any restrictions on the present invention. Those skilled in the art can understand that modifications within the scope of not deviating from the essence and concept of the present invention shall fall within the scope of protection of the present invention. Unless otherwise specified, the reagents and instruments used in the following embodiments are all commercially available products.

Embodiment 1

Figure 1:
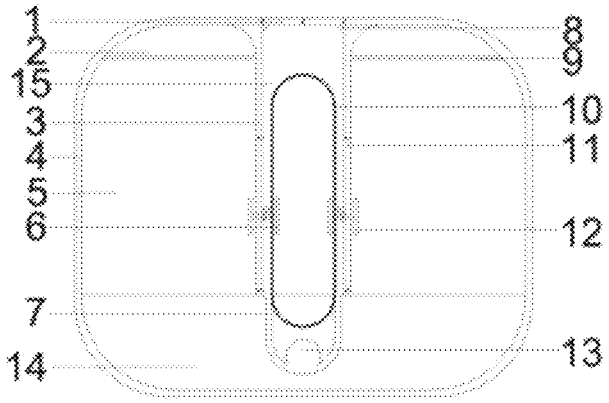
FIG. 1 shows a front sectional structural schematic diagram of the present invention.
Figure 2:
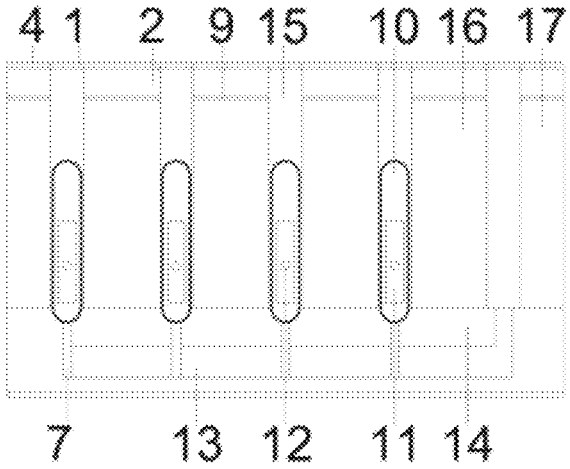
FIG. 2 shows a lateral sectional structural schematic diagram 1 of the present invention.
Figure 3:
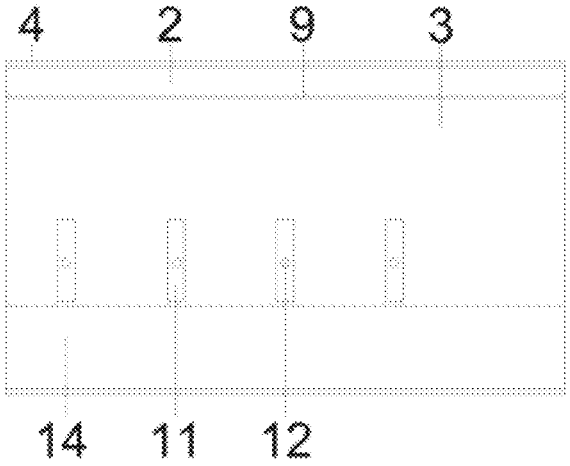
FIG. 3 shows a lateral sectional structural schematic diagram 2 of the present invention.
Figure 4:
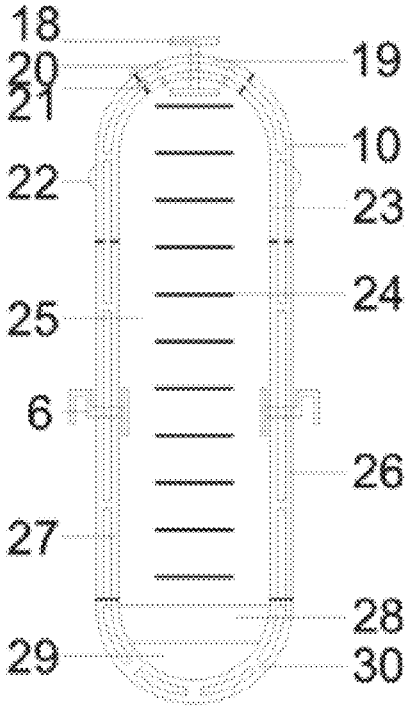
FIG. 4 shows a sectional structural schematic diagram of the rescue capsule in the present invention.
Figure 5:
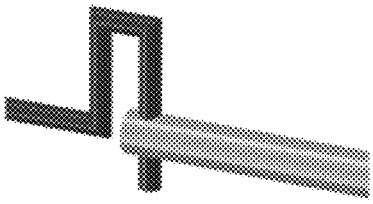
FIG. 5 shows a detailed schematic diagram 1 of connection of an N-shaped rotary lock switch and a first rotary lock switch lock switch in the present invention.
Figure 6:
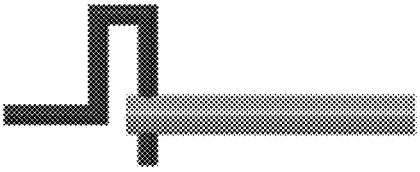
FIG. 6 shows a detailed schematic diagram 2 of connection of an N-shaped rotary lock switch and a first rotary lock switch in the present invention.
Figure 7:
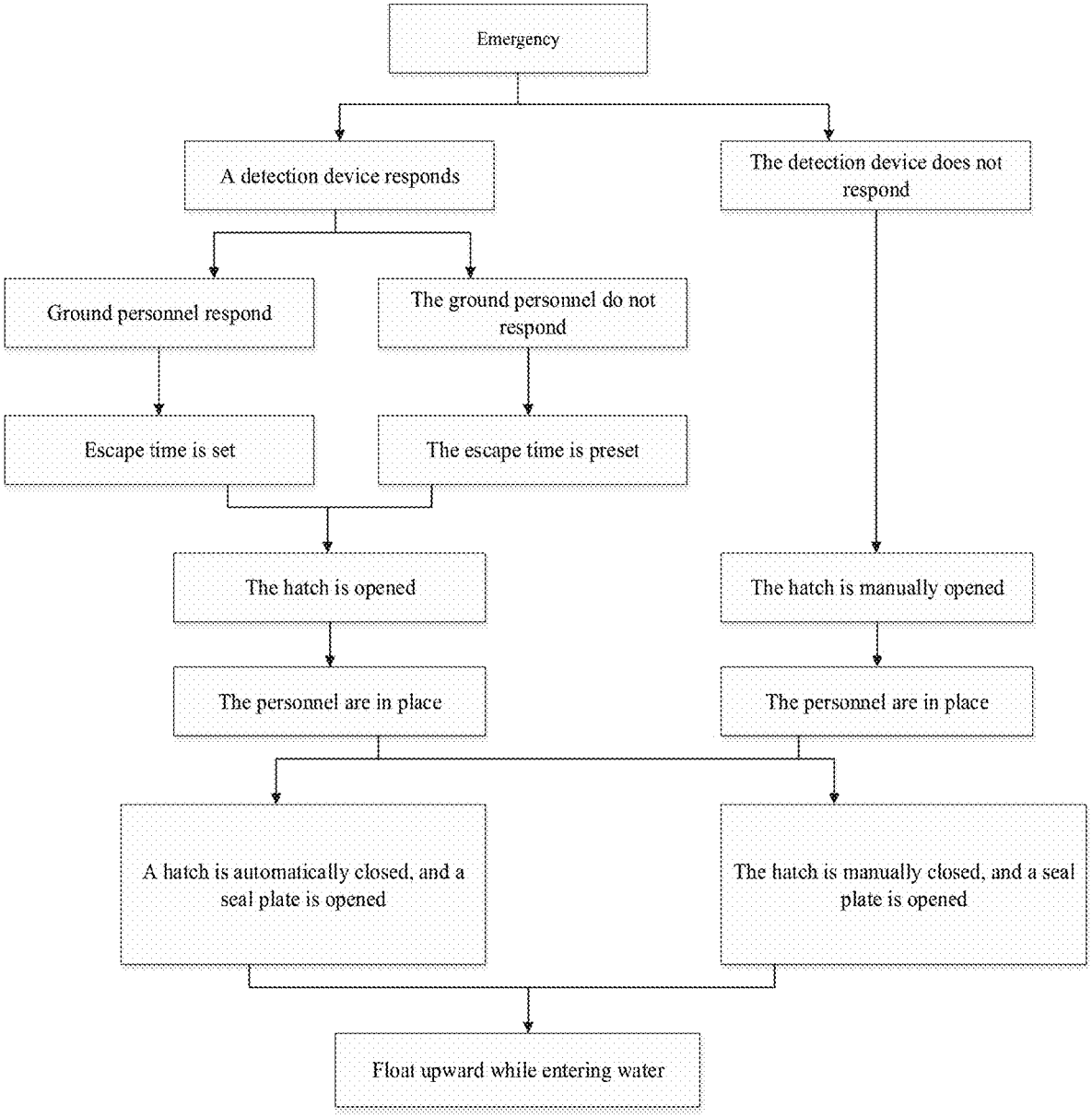
FIG. 7 shows a flowchart of escape in the present invention.

As shown in FIGS. 1, 2, 3, 4, 5, 6 and 7, a fabricated ocean tunnel structure with an escape device, including a fabricated ocean tunnel structure and an escape device. The escape device is located at the middle portion of the ocean tunnel structure, and the middle portion is fixed to a first rotary lock switch 12 by means of an N-shaped rotary lock switch 6.

The fabricated ocean tunnel structure includes a tunnel outer wall 4, a tunnel middle wall 16, a tunnel sidewall 17, a motor equipment bin 2, a top plate 9, a partition plate 3, a traffic area 5, a middle bin 15, a primary water pipe 13, a secondary water pipe 7, a partition door 11, a first rotary lock switch 12, a pavement area 14, a seal plate 1 and a seal plate knob 8.

The tunnel sidewall 17 is located at both ends of the tunnel and located in the middle of the tunnel, the tunnel middle wall 16 is located at the middle portion of the tunnel and located in the middle of the tunnel, the top plate 9 is located at the upper portion of the tunnel to separate the traffic area 5 and the motor equipment bin 2, the partition plate 3 is located in the middle of the tunnel, the partition plate 3 separates the middle bin 15 in the tunnel, meanwhile the partition plate 3 is attached to the tunnel sidewall 17 and the tunnel middle wall 16, and the pavement area 14 is distributed at the bottom of the tunnel.

The primary water pipe 13 is buried at the middle portion of the pavement area 14, starting from the middle bin 15 at the edge of the tunnel and ending, in the tunnel direction, at the middle bin 15 at the other end of the tunnel, and the secondary water pipe 7 is located between the primary water pipe 13 and the middle bin 15.

The partition doors 11 are evenly arranged in the partition plate 3 at certain intervals, the first rotary lock switch 12 is located on the partition door 11, the partition door 11 can be opened and closed by rotating the first rotary lock switch clockwise and counterclockwise, and the seal plate 1 is located at the top of the middle bin 15 and can be opened and closed in the tunnel direction along with the seal plate knob 8 at the edge of the seal plate 1.

The escape device includes a rescue capsule outer wall 10, a rescue capsule inner wall 23, a support 30, an N-shaped rotary lock switch 6, a rescue capsule outer wall hatch 26, a rescue capsule inner wall hatch 27, a bidirectional rotary lock switch 18, a rescue capsule top hatch 19, an observing window hole 20, a rescue capsule knob 21, a GPS positioning device 22, a transverse ladder 24, a rescue area 25, a rescue equipment area 28 and a balancing weight block 29.

The rescue capsule outer wall 10 is separated from the rescue capsule inner wall 23 by a certain gap and connected thereto by means of the arranged support 30 distributed at a specified position, the rescue capsule outer wall hatch 26 and the rescue capsule inner wall hatch 27 are located on both sides of the middle portion of the rescue capsule outer wall 10 and the rescue capsule inner wall 23 and connected by means of the N-shaped rotary lock switch 6, the N-shaped rotary lock switch 6 is located at the middle portion of the outer rescue capsule door 26 and the outer rescue capsule door 26, the rescue capsule top hatch 19 is located at the top of the rescue capsule, and the bidirectional rotary lock switch 18 is located at the middle portion of the rescue capsule top hatch 19, and can rotate inside and outside the rescue capsule to open or close the rescue capsule top hatch 19.

The observing window hole 20 is located on the periphery of the rescue capsule top hatch 19, the rescue capsule knob 21 is located at the edge of the rescue capsule top hatch 19 so that the rescue capsule top hatch 19 can rotate.

The GPS positioning device 22 is located on the upper side of the outer portion of the rescue capsule outer wall 10.

The rescue area 25 is located in an inner area of the rescue capsule inner wall 23, the transverse ladders 24 are horizontally and evenly distributed in the rescue capsule inner wall 23, the balancing weight block 29 is located at the bottommost portion of the rescue area 25, the rescue equipment area 28 is located at the upper portion of the balancing weight block 29, and the balancing weight block 29 and the rescue equipment area 28 are detachable.

One design size is that the internal radius of the rescue capsule is 400 mm, the thickness of the rescue capsule inner wall 23 is 12 mm, the gap between the rescue capsule inner wall 23 and the rescue capsule outer wall 10 is 10 mm, the thickness of the rescue capsule outer wall 10 is 10 mm, the bucket height of the rescue capsule is 2,400 mm, the total height is 3,264 mm, the total mass is 1.46 tons, and the drainage mass after completely entering the water is 1.83 tons. The device is 20 kg, the oxidant (sodium peroxide) is 30 kg, and the water and food are 10 kg. Theoretically, the load can be less than 290 kg. If the floating acceleration under no load is about 2 m/s2, the balancing weight block 29 and other articles can be abandoned in a special circumstance to increase the load. The oxidant can provide one person with stable breathing for eight days. After floating onto the surface of the sea, the rescue capsule top hatch 19 can be opened to breathe air.

When the fabricated ocean tunnel structure is installed, the seal plate 1 is rotated and opened in the tunnel direction through the seal plate knob 8, then the rescue capsule is hoisted into the middle bin 15, the N-shaped rotary lock switch 6 is vertically and downwards connected and fixed to the first rotary lock switch 12 by means of a buckle, and the lower portion of the N-shaped rotary lock switch contacts the pavement area 14. The seal plate 1 is closed and then the installation of the rescue device is completed, then splicing installation for offshore operations is performed according to a common fabricated construction process.

In normal operation, the tunnel outer wall 4 is in contact with the ocean environment and bears dynamic loads such as structural weight, water pressure and waves. The tunnel middle wall 16 and the tunnel sidewall 17 support the middle portion of the tunnel and bear part of the upper load which is transferred to the tunnel outer wall 4 at the bottom of the tunnel. The motor equipment bin 2 at the upper portion of the tunnel stores a device such as a wire and optical cable ventilation duct, and the top plate 9 bears the vertical load of the device in the motor equipment bin 2. A vehicle runs on the pavement area 14 in the traffic area 5, and there is no water flow between the primary water pipe 13 and the secondary water pipe 7 during normal operation. Usually, the seal plate 1 is in a sealed state, only the partition plate 3 and the partition door 11 can be seen in the traffic area 5, and the rescue capsule is located in the partition plate 3.

In case of emergency escape, there are four scenarios as follows:

(1) the first scenario is that a detection device detects that a disaster occurs and personnel need to escape, and ground personnel check, after receiving the news, the disaster situation, determine the personnel evacuation situation and set an escape time; the partition door 11, the rescue capsule outer wall hatch 26 and the rescue capsule inner wall hatch 27 drive the N-shaped rotary lock switch 6 to open automatically with the rotation of the first rotary lock switch 12, the hatches are automatically closed when the personnel are in place, and meanwhile the seal plate 1 is opened into the tunnel by means of the seal plate knob 8, so that seawater pours into the middle bin 15.

(2) The second scenario is that the detection device detects that a disaster occurs and personnel need to escape, and the ground personnel fail, after receiving the news, to make a judgment in time; according to a preset escape time of the system, the partition door 11, the rescue capsule outer wall hatch 26 and the rescue capsule inner wall hatch 27 drive the N-shaped rotary lock switch 6 to open automatically with the rotation of the first rotary lock switch 12, the hatches are closed manually when the personnel are in place, the seal plate 1 is opened in linkage, and the seawater pours into the middle bin 15.

(3) The third scenario is that the detection device detects that a disaster occurs and personnel need to escape, and the ground personnel fail, after receiving the news, to make a judgment in time; and according to a preset escape time of the system, the partition door 11, the rescue capsule outer wall hatch 26 and the rescue capsule inner wall hatch 27 drive the N-shaped rotary lock switch 6 to open automatically with the rotation of the first rotary lock switch 12, the hatches are automatically closed when the personnel are in place, and meanwhile the seal plate 1 is opened into the tunnel by means of the seal plate knob 8, so that the seawater pours into the middle bin 15.

(4) The fourth scenario is that the detection device fails to detect a disaster, the personnel rotate the first rotary lock switch 12 on the partition door 11 by themselves, the partition door 11, the rescue capsule outer wall hatch 26 and the rescue capsule inner wall hatch 27 drive, with the rotation of the rotary lock switch, the N-shaped rotary lock switch 6 to open, the N-shaped rotary lock switch 6, after the personnel are in place, is manually rotated to close the hatches, and meanwhile the seal plate 1 is opened in linkage, so that the seawater pours into the middle bin 15.

There are two ways to cause the middle bin 15 full of seawater: the first way is that the seawater downward pours from a position where the seal plate 1 at the upper portion of the middle bin 15 is opened, and the other way is that the seawater pours into the middle bin 15 by means of the primary water pipe 13 and the secondary water pipe 7 after pouring from another middle bin 15, so as to ensure that the middle bin 15 is filled with the seawater.

Then, after the buoyancy of the rescue capsule is greater than the gravity thereof, the rescue capsule floats upward, and the N-shaped rotary lock switch 6 is vertically separated from the first rotary lock switch 12, thus automatically canceling the fixation of the rescue capsule; due to the function of the balancing weight block 29, the floating posture of the rescue capsule remains stable, and the GPS positioning device 22 is turned on after encountering water, so that external search and rescue personnel can locate the rescue capsule in real time; and the rescue equipment area 28 is equipped with oxidant sodium peroxide and the like, and further with food and water, which can ensure the life needs of an evacuee within a certain period of time.

After the rescue capsule floats to the surface of the sea, the personnel, after determining an arrival at the surface of the sea through the observing window hole 20, climb the transverse ladder 24 and rotate the bidirectional rotary lock switch 18 to open the rescue capsule top hatch 19 by means of the rescue capsule knob 21 to breathe air and wait for rescue, and meanwhile a rescuer can also rotate the bidirectional rotary lock switch 18 from the outside to open the rescue capsule top hatch 19 for rescue.

The above embodiments are merely used for illustration of the technical solutions of the present invention, but not limit them. Although the present invention has been described in detail with reference to the foregoing embodiments, those of ordinary skills in the art should understand that: the technical solutions described in the foregoing embodiments may still be modified, or equivalent substitutions to some of the technical features may be performed. However, these modifications or substitutions do not make the essence of the corresponding technical solutions deviate from the spirit and scope of the technical solutions set forth in the present invention.

What is claimed is:

1. A fabricated ocean tunnel structure with an escape device, comprising:

a fabricated ocean tunnel structure and an escape device, wherein the fabricated ocean tunnel structure comprises a tunnel outer wall, a top plate and a partition plate;

the top plate is located at the upper portion of the fabricated ocean tunnel structure; a motor equipment bin is arranged above the top plate, a traffic area is arranged below the top plate, and a pavement area is arranged at the bottom of the traffic area;

the partition plate is located within the fabricated ocean tunnel structure and a middle bin is formed by the partition plates positioning within the fabricated ocean tunnel structure, the escape device is arranged in the middle bin, and the escape device is detachably connected with the middle bin; switchable partition doors are evenly arranged on the partition plate, and a switchable seal plate is arranged at the top of the middle bin;

the escape device comprises a rescue capsule, a switchable rescue capsule hatch and a switchable rescue capsule top hatch are respectively arranged on the side and at the top of the rescue capsule, transverse ladders are evenly arranged in the rescue capsule in the height direction, a balancing weight block is arranged at the bottom of the rescue capsule, and a rescue equipment area are arranged above the balancing weight block;

a primary water pipe is buried in the middle of the pavement area, and the primary water pipe communicates the middle bin arranged in the length direction of the fabricated ocean tunnel structure; a secondary water pipe is arranged between the primary water pipe and the middle bin;

the rescue capsule comprises a rescue capsule outer wall and a rescue capsule inner wall, wherein a rescue capsule outer wall hatch and a rescue capsule inner wall hatch are respectively arranged on the rescue capsule outer wall and the rescue capsule inner wall, and the rescue capsule outer wall hatch and the rescue capsule inner wall hatch are connected through an N-shaped rotary lock switch; a bidirectional rotary lock switch is arranged on the rescue capsule top hatch, and the rescue capsule top hatch can be opened or closed inside and outside the rescue capsule by rotating the bidirectional rotary lock switch; and the escape device and the middle bin are fixed to a first rotary lock switch by means of the N-shaped rotary lock switch.

2. The fabricated ocean tunnel structure with an escape device according to claim 1, wherein the fabricated ocean tunnel structure also comprises tunnel sidewalls and a tunnel middle wall, wherein the tunnel sidewalls are located at both ends of the fabricated ocean tunnel structure, and the tunnel middle wall is located in the middle of the fabricated ocean tunnel structure; and the partition plate is attached to the tunnel sidewalls and the tunnel middle wall.

3. The fabricated ocean tunnel structure with an escape device according to claim 1, wherein the partition door is provided with the first rotary lock switch, and the partition door can be opened and closed by clockwise and counter-clockwise rotation of the first rotary lock switch; and the seal plate is provided with a seal plate knob, and the seal plate can be opened and closed in the tunnel direction through the rotation of the seal plate knob.

4. The fabricated ocean tunnel structure with an escape device according to claim 1, wherein the rescue capsule outer wall is separated from the rescue capsule inner wall by a certain gap, and the rescue capsule outer wall is connected to the rescue capsule inner wall through an arranged support distributed at a specified position.

5. The fabricated ocean tunnel structure with an escape device according to claim 1, wherein the rescue capsule outer wall hatch and the rescue capsule inner wall hatch are arranged on both sides of the middle portion of the rescue capsule outer wall and the rescue capsule inner wall.

6. The fabricated ocean tunnel structure with an escape device according to claim 1, wherein an observing window hole is arranged on the periphery of the rescue capsule top hatch, a Global Positioning System (GPS) positioning device is arranged on the upper side of the outer portion of the rescue capsule outer wall, and the balancing weight block and the rescue equipment area are detachable.

* * * * *